US005137076A

United States Patent [19]

Takahashi

[11] Patent Number: 5,137,076

[45] Date of Patent: Aug. 11, 1992

[54] STEPPED CORE PIN FOR A CASTING MOLD

[75] Inventor: Katsuhiko Takahashi, Tokyo, Japan

[73] Assignee: Ahresty Corporation, Tokyo, Japan

[21] Appl. No.: 540,775

[22] Filed: Jun. 20, 1990

[30] Foreign Application Priority Data

Mar. 31, 1990 [JP] Japan ..... 2-35230[U]

[51] Int. Cl.[5] ..... B22D 17/22

[52] U.S. Cl. ..... 164/320; 164/340

[58] Field of Search ..... 164/320, 340; 249/151; 425/577

[56] References Cited

U.S. PATENT DOCUMENTS

| | | | |
|---|---|---|---|
| 4,275,864 | 6/1981 | Richards | 425/577 X |
| 4,298,566 | 11/1981 | Naus et al. | 425/577 X |
| 4,452,420 | 6/1984 | Lundquist | 425/577 X |
| 4,711,752 | 12/1987 | Deacon et al. | 249/151 X |
| 4,732,726 | 3/1988 | Grannen, III | 425/577 X |
| 4,779,665 | 10/1988 | Ouimet | 164/320 X |
| 4,958,676 | 9/1990 | Kuntz | 164/340 |

FOREIGN PATENT DOCUMENTS

| | | | |
|---|---|---|---|
| 47-14634 | 5/1972 | Japan | 164/320 |
| 63-179168 | 7/1988 | Japan | 249/151 |
| 63-235056 | 9/1988 | Japan | 164/340 |
| 63-189462 | 12/1988 | Japan . | |

*Primary Examiner*—J. Reed Batten, Jr.

*Attorney, Agent, or Firm*—Watson, Cole, Grindle & Watson

[57] ABSTRACT

The stepped core pin has a shank to be fitted in a pin holding bore formed in a wall of a casting mold and a forming portion having a diameter smaller than that of the shank which is projected from the inner surface of the casting mold defining a mold cavity into the mold cavity. A front portion of the shank is reduced to form a neck portion and a molten metal stopping portion is formed between the neck portion and the forming portion. The diameter of the molten metal stopping portion, which is slightly smaller than that of the shank excluding the neck portion, is determined so that a clearance through which the molten metal is unable to leak into the pin holding bore is formed between the outer circumference of the pin holding bore and the inner circumference of the molten metal stopping portion. This clearance effectively combines the length of the forming portion with the length of the neck, thereby reducing stress and fatigue to the projected forming portion.

14 Claims, 1 Drawing Sheet

STEPPED CORE PIN FOR A CASTING MOLD

BACKGROUND OF THE INVENTION

1. Technical Field of the Invention

The present invention relates generally to a core pin to be placed in the mold cavity of a casting mold, such as a die-casting mold, to form a prepared hole for tapping or the like in a casting and, more specifically, to a stepped core pin having a shank to be inserted in a pin holding bore formed in a casting mold and a forming portion having a diameter smaller than that of the shank which projects into the mold cavity of the casting mold from the inner surface of the casting mold defining the mold cavity.

2. Discussion of the Related Art

The forming portion of the stepped core pin projecting from the inner surface of the casting mold defining the mold cavity of a casting mold is exposed repeatedly to the shrinking action (bending stress) of molten metal poured into the mold cavity of the casting mold during the solidification of the molten metal.

The stepped core pin is provided within the casting mold with its shank fitted in a pin holding bore formed in the casting mold and with the forming portion having a diameter smaller than that of the shank and extending from the shank into the mold cavity of the casting mold. Since the bending stress induced by the shrinking force of the molten metal developed during the solidification of the molten metal is concentrated on the base of the forming portion, the stepped core pin is liable to be broken at the base of the forming portion.

To improve the stepped core pin having such a disadvantage, Japanese Utility Model Laid-open (Kokai) No. 63-189462 proposed a stepped core pin for a casting mold having a stress relieving groove in a portion between its shank to be fitted in a pin holding bore formed in a casting mold and its forming portion extending from the shank in order to distribute the stress induced in the forming portion by the shrinking force during solidification. This previously proposed stepped core pin, however, has not been particularly effective in obviating stress concentration because a portion of the shank contiguous with the base of the forming portion is fitted closely in the pin holding hole of the casting mold.

Accordingly, it is an object of the present invention to provide a stepped core pin having a forming portion to be projected from the inner surface of the casting mold defining a mold cavity into the mold cavity, designed so that no bending stress resulting from the shrinkage of molten metal poured into the mold cavity during solidification will be induced in the base of the forming portion, which is capable of enduring repetitive stress (bending stress) induced by the shrinking action of the molten metal poured into the mold cavity during solidification, and which is capable of being serviceable for a long period of use without breaking.

Other objects and advantages of the present invention will become apparent from the drawing and specification which follow.

SUMMARY OF THE INVENTION

To achieve the foregoing and additional objects, the present invention provides a stepped core pin for a casting mold, having a shank to be fitted in a pin holding bore formed in a casting mold and a forming portion having a diameter smaller than that of the shank and to be projected from the inner surface of the casting mold defining a mold cavity into the mold cavity, characterized in that the diameter of a front portion of the shank is reduced to form a neck portion, a molten metal stopping portion is formed between the neck portion and the forming portion with a diameter slightly smaller than that of the shank excluding the neck portion, and the diameter of the molten metal stopping portion is determined so that a clearance through which the molten metal is unable to leak into the pin holding bore is defined between the circumference of the pin holding bore and the circumference of the molten metal stopping portion.

Other objects and novel features of the present invention will become more apparent from the following description taken in connection with the accompanying drawings, which, however, are intended to illustrate the invention and are not to be construed to limit the scope of the present invention.

DETAILED DESCRIPTION OF THE PREFERRED EMBODIMENTS

Figure 1:
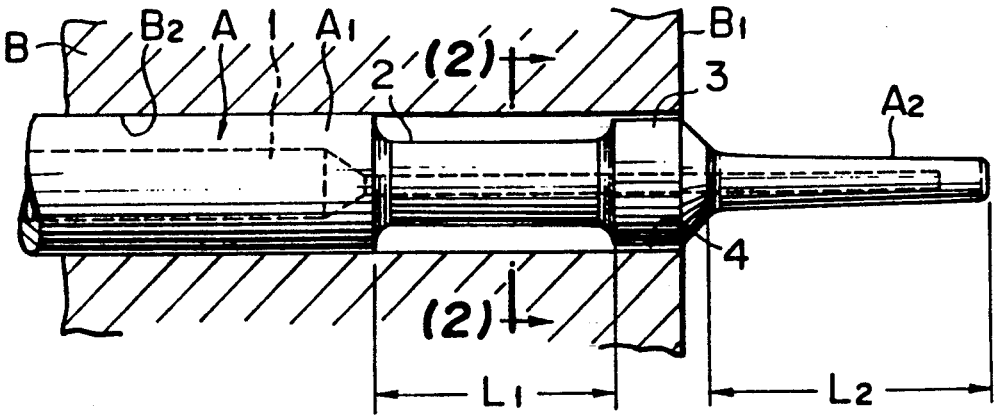
FIG. 1 is a sectional view of a casting mold provided with a stepped core pin of a first embodiment according to the present invention.
Figure 2:
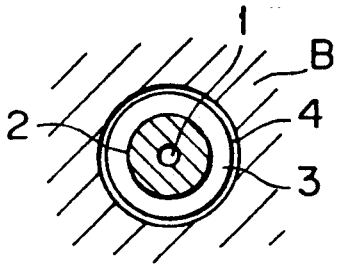
FIG. 2 is a sectional view taken on line (2)—(2) in FIG. 1.

Referring to FIGS. 1 and 2, a stepped core pin A of a first embodiment according to the present invention is integrated into a casting mold B having a mold cavity.

Basically, the stepped core pin A, similar to the conventional stepped core pin, has a shank A fitted in a pin holding bore $B_2$ formed through one of the walls of the casting mold B from the inner surface $B_1$ to the outer surface of the casting mold B open to the mold cavity, and a forming portion $A_2$ formed integrally with the shank $A_1$ in a diameter smaller than that of the shank $A_1$ so as to project from the inner surface $B_1$ into the mold cavity. The stepped core pin A is provided internally with a cooling bore 1 extending through the shank $A_1$ and the forming portion to supply cooling water into the cooling bore 1 when necessary.

The diameter of a front portion of the shank $A_1$ fitted in the pin holding bore $B_2$ of the casting mold B is reduced to form a cylindrical neck portion 2 located within the bore and having a diameter sufficiently smaller than that of the shank $A_1$. A molten metal stopping portion 3 is formed between the neck portion 2 and the forming portion $A_2$.

Figure 3:
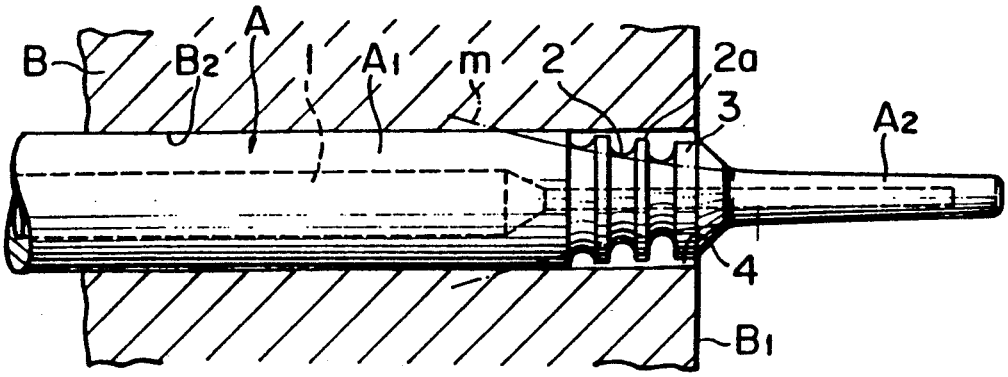
FIG. 3 is a sectional view of a casting mold provided with a stepped core pin of a second embodiment according to the present invention.

The neck portion 2 is formed to reduce a maximum bending stress induced in the base of the forming portion $A_2$ by a bending force developed during solidification by the shrinkage of the molten metal filling the mold cavity of the casting mold B. A plurality of neck portions 2 may be formed in a front portion of the shank $A_1$ extending within the pin holding bore $B_2$ near the inner surface $B_1$. The stepped core pin in the first embodiment shown in FIGS. 1 and 2 is provided with the single neck portion 2 of a wide width in the front portion of the shank $A_1$ extending within the pin holding bore $B_2$ near the inner surface $B_1$. A stepped core pin of a second embodiment according to the present invention shown in FIG. 3 has a forming portion $A_2$, a shank $A_1$ provided with three neck portions 2 having the shape of an annular groove of equal widths in its front portion at equal intervals, and a molten metal stopping portion 3. The respective bottoms of the neck portions 2 are substantially in contact with, i.e., lie on, a conical surface m including the surface of the forming portion tapered at a draft, so that the depth of the neck portion 2 nearer to the shank $A_1$ is smaller than that of the neck portion 2 nearer to the forming portion $A_2$. The respective diameters of the lands 2*a* between the neck portions 2 are equal to each other and the same as that of the molten metal stopping portion 3, or the diameter of the land 2*a* nearer to the shank $A_1$ is greater than that of the land 2*a* nearer to the forming portion $A_2$. In the second embodiment, the neck portions 2 may be the same in diameter, may be different from each other in width and/or may be formed at irregular intervals. In the first embodiment, it is preferable that the diameter of the neck portion is sufficiently smaller than that of the shank $A_1$, more specifically, substantially the same as that of the forming portion $A_2$, and the length $L_1$ of the neck portion 2 is substantially the same as the length $L_2$ of the forming portion. Such a configuration of the neck portion 2 reduces the stress induced in the base of the forming portion $A_2$ even more effectively, as described below.

The molten metal stopping portion 3 is formed between the neck portion 2 of the shank $A_1$ and the forming portion $A_2$ near the inner surface $B_1$ of the casting mold B to prevent a leak of the molten metal filling the mold cavity of the casting mold B into the pin holding bore B of the casting mold B. The front end surface of the molten metal stopping portion 3 is flush with the inner surface $B_1$ of the casting mold B. The diameter of the molten metal stopping portion 3 is slightly smaller than that of the shank $A_1$ excluding the neck portion 2 and greater than that of the neck portion and the forming portion, and is determined so that a clearance 4 through which the molten metal is unable to leak into the pin holding bore is formed between the inner circumferential surface of the pin holding bore $B_2$ and the outer circumferential surface of the molten metal stopping portion 3. It is preferable that the size of the clearance 4 is as large as possible. The size of the clearance 4 is dependent on the viscosity and pressure of the molten metal filling the mold cavity of the casting mold B Results of experiments have shown that the molten metal is unable to leak from the mold cavity through the clearance 4 into the pin holding bore $B_2$ of the casting mold B in ordinary die casting when the size of the clearance is not greater than 0.15 mm.

FUNCTION AND EFFECT OF THE INVENTION

The stepped core pin thus formed in accordance with the present invention forms a clearance 4 between the circumference of the pin holding bore $B_2$ of the casting mold B and the circumference of the molten metal stopping portion 3 when the stepped core pin is integrated into the casting mold B with its shank $A_1$ fitted in the pin holding bore $B_2$, and the molten metal stopping portion 3 is able to move within a range defined by the clearance 4. Accordingly, a bending stress induced in the stepped core pin by the bending force developed by the shrinkage of the molten metal filling the mold cavity of the casting mold during solidification is not concentrated on the base of the forming portion $A_2$ but rather is distributed over a portion of a length $L_1+L_2$ including the neck portion 2 because the molten metal stopping portion 3 is allowed to move in the range defined by the clearance 4. That is, since the molten metal stopping portion 3 is allowed to move within the range defined by the clearance 4, the apparent length of the forming portion $A_2$ is increased by $L_2$ to $L_1+L_2$, i.e., the total length of the forming portion $A_2$ and the neck portion 2. The portion of the length $L_1+L_2$ is obviously more flexible than the forming portion $A_2$ of the length $L_1$ so that a reduced bending stress is induced in the forming portion $A_2$. Consequently, the failure of the base of the forming portion $A_2$ due to fatigue is obviated even if the forming portion $A_2$ is exposed to repeated bending stress induced by a force developed by the shrinkage of the molten metal filling the mold cavity of the casting mold during solidification.

The cooling bore formed in the stepped core pin in a section corresponding to the shank and the forming portion further enhances the flexibility of the portion of the length $L_1+L_2$ including the neck portion and the forming portion and hence further reduces the concentration of stress on the base of the forming portion to enhance the durability of the stepped core pin.

Further modifications and improvements will become apparent to one skilled in the art without departing from the spirit and scope of the present invention as defined in the following claims.

I claim:

1. The combination of a stepped core pin and a casting mold having a mold cavity and a pin bore formed in a wall of the cavity and open toward the cavity, the stepped core pin comprising:
   - a shank fitted into the pin bore;
   - a forming portion having a diameter which is less than the diameter of the shank, the forming portion extending into the mold cavity;
   - a neck portion formed in front of the shank toward the forming portion and located within the pin bore, the neck portion having a diameter which is less than the diameter of the shank; and
   - a molten metal stopping portion formed between the neck portion and the forming portion, the stopping portion have an outer surface which has a diameter which is less than the diameter of the shank, wherein a clearance is defined between the stopping portion outer surface and the pin bore inner surface which prevents molten metal in the mold cavity from leaking into the pin bore.

2. The combination according to claim 1, wherein the neck portion diameter and the forming portion diameter are substantially the same.

3. The combination according to claim 1, wherein the neck portion and the forming portion have substantially the same length.

4. The combination according to claim 1, wherein the neck portion comprises a cylinder.

5. The combination according to claim 1, wherein the neck portion tapers from the shank to the molten metal stopping portion.

6. The combination according to claim 1, wherein the neck portion has annular grooves with lands therebetween.

7. The combination according to claim 6, wherein the annular grooves have equal widths.

8. The combination according to claim 6, wherein the bottoms of the annular grooves lie on a conical surface which tapers from the shank to the molten metal stopping portion.

9. The combination according to claim 8, wherein the annular grooves have equal widths.

10. The combination according to claim 9, wherein a first land closer to the shank has a diameter which is greater than the diameter of a second land closer to the stopping portion.

11. The combination according to claim 6, wherein the annular grooves have equal widths.

12. The combination according to claim 6, wherein a first land closer to the shank has a diameter which is greater than the diameter of a second land which is closer to the stopping portion.

13. The combination according to claim 1, wherein a cooling bore extends through the shank, neck portion, stopping portion and into the forming portion.

14. The combination according to claim 1, wherein the stopping portion diameter is slightly less than the shank diameter and is greater than the respective diameters of the forming portion and the neck portion.

* * * * *